US005312655A

United States Patent [19]

Hultberg

[11] Patent Number: 5,312,655

[45] Date of Patent: May 17, 1994

[54] DECORATION MEANS

[76] Inventor: Ann-Margret Hultberg, Ljungvägen 3, S-263 32 Höganäs, Sweden

[21] Appl. No.: 768,403

[22] PCT Filed: Mar. 7, 1990

[86] PCT No.: PCT/SE90/00146

§ 371 Date: Sep. 11, 1991

§ 102(e) Date: Sep. 11, 1991

[87] PCT Pub. No.: WO90/11027

PCT Pub. Date: Oct. 4, 1990

[30] Foreign Application Priority Data

Mar. 20, 1989 [SE] Sweden ..... 8900974

[51] Int. Cl.[5] ..... A41G 1/04

[52] U.S. Cl. ..... 428/10; D11/120; 428/27; 493/958

[58] Field of Search ..... 428/10, 21, 27, 15; 493/958; 362/122; D11/120

[56] References Cited

U.S. PATENT DOCUMENTS

| | | | |
|---|---|---|---|
| 1,158,076 | 10/1915 | Rossig et al. | 428/10 |
| 1,960,476 | 5/1934 | Cohen | 428/10 |
| 3,526,992 | 9/1970 | Foster | 248/27.8 X |
| 3,591,442 | 7/1971 | Matesi | 428/10 |

*Primary Examiner*—Henry F. Epstein

*Attorney, Agent, or Firm*—Kane, Dalsimer, Sullivan, Kurucz, Levy, Eisele and Richard

[57] ABSTRACT

The invention relates to a decoration and a method of making such decoration comprising a plurality of separate, artificial plant parts. The method is characterized by overlappingly connecting separate, juxtaposed first plant parts at a distance from a front edge of the respective plant part, and of overlappingly connecting a plurality of separate, mutually overlapping second plant parts to said first plant parts. As a result, an area of each of said first plant parts facing away from the front edge is covered, like the connection, by the overlapping portion of each of the second plant parts. The decoration is intended for use in the making of a wreath.

10 Claims, 1 Drawing Sheet

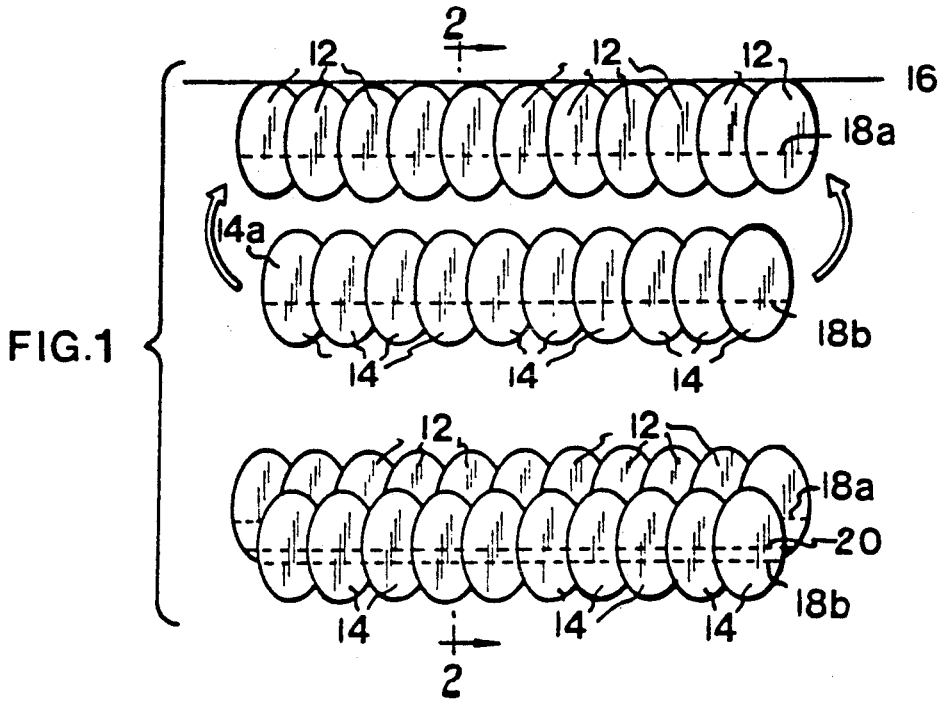
FIG.1
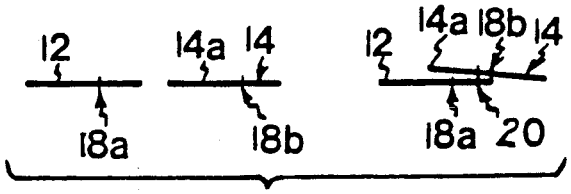
FIG.2
FIG.3
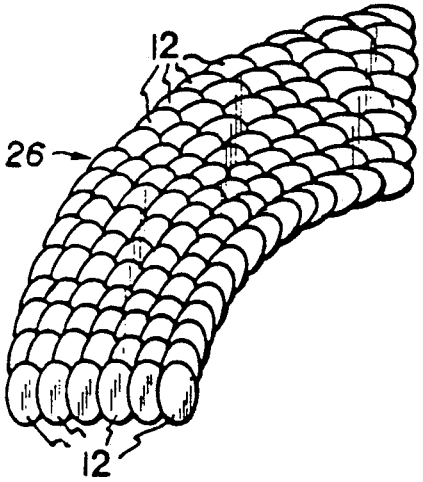
FIG.4
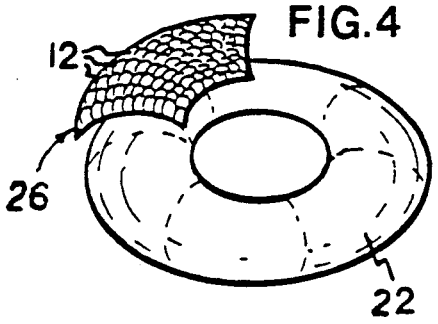
FIG.5
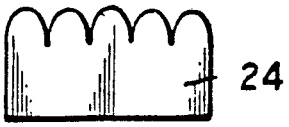

DECORATION MEANS

FIELD OF THE INVENTION

The present invention relates to a decoration which can be used especially in the florist trade, and to a method of making such a decoration.

DESCRIPTION OF THE PRIOR ART

A common task of florists is to make wreaths for use in connection with funerals or cremations. Such a wreath substantially consists of two parts, namely a wreath body and a decoration, such as flowers, ribbons etc, fixed to the wreath body. Today, ready-made wreath bodies are available, which may consist of straw held in place by a plastic sheeting wrapped around the wreath body. Other types of wreath bodies, such as those disclosed in U.S. Pat. No. 3,526,992 or EP-A1-0,241,341, are previously known. Most often, they consist of a porous foam material which in some cases is supported by a waterproof backing (cf. GB-A-1,544,630). Naturally, the technical development in respect of wreath bodies and wreath body materials facilitates the task of the florist when making wreaths. Thus, the florist need not waste any time on shaping the wreath body, provided the customer is content with the wreath sizes available. This of course has a favourable effect on the end price of the wreath.

The wreath body must be decked with some type of decoration, such as flowers, leaves, ribbons etc. No actual development has taken place in this respect, save that use is now made of leaves of plastic or cloth, or silk, which are easier to handle and do not wither. That no technical development has in principle occurred largely depends on the fact that the very decoration of the wreath body is considered dependent to a large extent on the craftsmanship of the florist, excluding all technical development. Although the craftsmanship of the florist is of decisive importance for the final appearance of the wreath, there are certain ways of facilitating the florist's work when making wreaths.

Thus, from DE-B-27,50,670 it is previously known to fix to a wreath body a block of flower foam which is soaked with water and used for fixing and continuously watering flowers on the wreath. However, before the florist gets that far, the wreath body must be provided with a suitable basic decoration, such as natural or artificial plant leaves. These are fixed to the wreath body by means of a steel wire which is wound around the wreath, whereby the leaves will be squeezed between the steel wire and the wreath body. A plurality of plant leaves are fixed to the wreath body for each turn of the winding, so that these leaves will cover the wreath body, and the following leaves must cover the preceding turn of the steel wire and the wreath body. After this operation, flowers, ribbons and the like can be attached to the wreath body for accomplishing the wreath.

Attaching the separate plant parts is a very time-consuming and, thus, costly operation. Apart from this, there is a substantial risk that these separate plant parts attached with steel wire may be displaced or torn loose during transportation of the wreath from the florist to e.g. a church ceremony, which, if things come to the worst, may mean that both the steel wire and the wreath body become visible, thus ruining the aesthetical appearance of the whole wreath.

SUMMARY OF THE INVENTION

One object of the present invention therefore is to provide a decoration where there is no risk that the separate plant parts may be displaced or torn loose.

Another object of the present invention is to provide a decoration with which different-sized wreath bodies can be decorated in a cost-effective way.

A third object of the present invention is to provide a method of making such a decoration.

These and other objects are achieved by means of a method of making a decoration comprising a plurality of separate, artificial plant parts, which method is characterised by the steps of overlappingly connecting separate, juxtaposed first plant parts at a distance from a front edge of the respective plant part, and of overlappingly connecting a plurality of separate, mutually overlapping second plant parts to said first plant parts, such that both an area of each of said first plant parts facing away from said front edge, and said connection are covered by the overlapping portion of each of said second plant parts.

To achieve these objects and to carry out the method of the invention, a decoration is further provided which comprises a plurality of separate, artificial plant parts, which decoration is characterised by first means provided at a distance from a front edge of the respective plant part for overlappingly connecting separate, juxtaposed first plant parts, and second means for overlappingly connecting a plurality of separate, mutually overlapping second plant parts to said first plant parts, such that both an area of each of said first plant parts facing away from said front edge, and said first means are covered by the overlapping portion of each of said second plant parts.

Other preferred embodiments are recited in the subclaims.

BRIEF DESCRIPTION OF THE DRAWINGS

The attached drawing illustrates one embodiment of a decoration according to the invention to be fixed to a wreath body, as will be described in more detail hereinbelow.

FIG. 1 shows an inventive working operation for joining together separate, artificial plant parts.

FIG. 2 is a sectional view taken along the line in FIG. 1.

FIG. 3 shows a ¼ of a circular-arc-shaped decoration according to the present invention.

FIG. 4 shows a wreath body immediately before applying the inventive decoration shown in FIG. 3.

FIG. 5 shows a lobated strip where the lobes resemble a plant part.

DETAILED DESCRIPTION OF THE PREFERRED EMBODIMENT

FIGS. 1 and 2 illustrate a working method according to the invention for joining together separate, artificial plant parts 12, 14 so as to form a decoration which can be used in the making of wreaths. In this illustrative embodiment, separate, juxtaposed first plant parts 12 are sewn together forming a seam (18*a*) at a distance from a front edge 16 of the respective plant part, such that adjacent plant parts will overlap each other. This yields a row of interconnected, mutually overlapping first plant parts 12. Similarly, there is provided a row of mutually overlapping second plant parts 14 sewn together forming a seam (18*b*).

In the following phase of operation, the row of the second plant parts 14 is applied on the row of the first plant parts 12 at a distance from the front edge 16 of the respective first plant parts 12, such that an overlapping portion 14*a* of the respective second plant parts 14 will cover the seam 18*a* and the end of the first plant parts 12 facing away from the front edge 16 thereof. The row of the second plant parts 14 is thereafter sewn forming a seam (20) to the row of the first plant parts 12. When a plurality of such rows have been fixed to each other in this manner, a "mat" 26 of interconnected plant parts is obtained without any visible joints (in this case, seams 18*a*, 18*b*, 20), where each separate plant part is anchored to prevent any displacement and/or extraction thereof, thus obviating the risk that the connection between different separate plant parts or the wreath body becomes visible after this "mat" 26 has been applied to the wreath body.

If, when joining together the different rows, one proceeds along circular arcs corresponding, respectively, to the inner and the outer periphery of the wreath body, an arcuate "mat" is thus obtained, it being preferred to make a ¼ circular-arc-shaped "mat" 26 (see FIG. 3).

FIG. 4 shows a wreath body 22 immediately before applying a ¼ circular-arc-shaped "mat" 26 of separate, artificial interconnected plant parts, which mat 26, depending on the material of the wreath body, is glued, riveted or fixed in any other suitable manner to the wreath body 22.

Thus, the wreath body can be completely covered with a basic decoration which here consists of four separate pieces of decoration. It will be appreciated that ⅓ circular-arc-shaped mats 26 may also be used, like completely circular-arc-shaped mats 26 of separate, artificial plant parts.

Also, it is possible to apply the separate, artificial first and second plant parts to a carrier, for instance a thin woven fabric, which would facilitate the joining together of the separate plant parts and make it easier to follow the above-mentioned circular arc. Also, the mat or mats 26 would become less sensitive to tensile forces and, hence, more resistant.

Although the connection of the different plant parts in the embodiment of the present invention described above consists of sewn seams, a man skilled in the art will realize that there are other suitable means for fastening and joining the separate, artificial first and second plant parts to each other, such as glue, rivets etc.

It has thus been shown that a decoration made in the manner described above will provide a basic decoration, e.g. for a wreath body, which is safely anchored against displacement and/or extraction, and that basic decorating can be done more rapidly and, hence, in a more cost-effective way. Thus, the florist may concentrate on what is essential for the final appearance of the wreath, that is the choice and arrangement of flowers, ribbons etc.

It is of course obvious to a man skilled in the art that the detail implementation of the inventive method and the detail design of the inventive decoration may be varied or modified. Thus, the separate leaves may be replaced by lobated strips 24, as shown in FIG. 5, which should give the impression of being composed of individual plant parts and which should then be overlappingly connected to each other as described above. Of course, it is also possible to use other artificial plant parts, and the method of joining them together may be carried out in other suitable ways, giving the same technical effect. It therefore is understood that the accompanying claims should be considered to comprise all changes and modifications falling within the scope of the inventive concept.

I claim:

1. A wreath body cover mat having a plurality of artificial plant parts, said wreath body cover mat comprising a plurality of elongated strips, each strip having lobes along at least one of its longitudinal edges representing said artificial plant parts, said strips successively overlapping each other such that the lobes of one strip cover an area of an overlapped strip facing away from the lobes of said overlapped strip, each successive pair of strips being fastened to each other along a fastening line extending along the full length of the strips, said fastening line being covered by the lobes of the next successive strip, whereby a wreath body cover mat of a desired shape may be formed.

2. A wreath body cover mat as claimed in claim 1, wherein successive fastening lines are diverging, whereby said wreath body cover mat is arcuate.

3. A wreath body cover mat as claimed in claim 2, wherein the two most remote fastening lines diverge approximately 120°.

4. A wreath body cover mat as claimed in claim 2, wherein the two most remote fastening lines diverge approximately 90°.

5. A wreath body cover mat as claimed in claim 1, wherein successive fastening lines are parallel.

6. A wreath body cover mat as claimed in claim 1, wherein each elongated strip comprises a plurality of separate artificial plant parts successively overlapping each other and being fastened to each other along lines extending along said fastening lines for fastening said elongated strips to each other.

7. A wreath body cover mat as claimed in claim 1, wherein said successive strips are glued to each other.

8. A wreath piece comprising a body and a plurality of artificial plant parts covering a front side of said body, wherein said plurality of artificial plant parts forms at least one wreath body cover mat comprising a plurality of elongated strips, each strip having lobes along at least one of its longitudinal edges representing said artificial plant parts, said strips successively overlapping each other such that the lobes of one strip cover an area of an overlapped strip facing away from the lobes of said overlapped strip, each successive pair of strips being fastened to each other along a fastening line extending along the full length of the strips, said fastening line being covered by the lobes of the next successive strip, whereby said wreath body cover mat has a shape corresponding to at least a part of the front side of said body..

9. A wreath piece as claimed in claim 8, wherein said body is a wreath body.

10. A wreath piece as claimed in claim 9, wherein said wreath body is covered by three wreath body cover mats.

* * * * *